US005277115A

United States Patent [19]

Vesa

[11] Patent Number: 5,277,115

[45] Date of Patent: Jan. 11, 1994

[54] FLIP-OUT MECHANISM FOR TARGET TRACKERS

[75] Inventor: Reijo Vesa, Karlskoga, Sweden

[73] Assignee: Bofors AB, Karlskoga, Sweden

[21] Appl. No.: 946,616

[22] Filed: Sep. 18, 1992

[30] Foreign Application Priority Data

Sep. 18, 1991 [SE] Sweden ..... 9102703-7

[51] Int. Cl.[5] ..... F42B 10/14; F42B 10/48

[52] U.S. Cl. ..... 102/388; 102/393; 244/3.28

[58] Field of Search ..... 102/388, 386, 387, 384, 102/393, 489; 244/3.27, 3.28, 3.29

[56] References Cited

U.S. PATENT DOCUMENTS

| | | | |
|---|---|---|---|
| 4,691,636 | 9/1987 | Witt et al. | 102/387 |
| 4,848,235 | 7/1989 | Postler | 102/393 |
| 4,858,532 | 8/1989 | Persson et al. | 102/387 |
| 5,063,849 | 11/1991 | Axinger | 102/388 |
| 5,088,414 | 2/1992 | Vesa | 102/388 |

FOREIGN PATENT DOCUMENTS

| | | |
|---|---|---|
| 0252036 | 1/1988 | European Pat. Off. . |
| 0424336 | 4/1991 | European Pat. Off. . |
| 1355471 | 6/1974 | United Kingdom . |

*Primary Examiner*—David H. Brown

*Attorney, Agent, or Firm*—Pollock, Vande Sande & Priddy

[57] ABSTRACT

A method is provided for retarding the movement of the flip-out target tracker during a final part of a flip-out without the contents or journalling of the target tracker being damaged. The flip-out target tracker is on a sub-combat unit which is transported by a carrier body to a predetermined target area in order to be activated at the target area during flip-out of the target tracker. The target tracker scans the target area during the braked fall of the sub-combat unit and identifies and combats targets by means of an integrated warhead. The retardation is effected with a flexible brake band. The brake band is initially folded and attached to the target tracker at a first anchorage point in the proximity of a portion of the target tracker which, during flip-out, moves the longest distance. The brake band is stretched past an elastically deformable damper body secured in a main portion of the sub-combat unit. The damper body is caused to be at least partially deformed by the brake band during the final stage of the flip-out phase so that the brake band is stretched between the first anchorage point and a second anchorage point in the main portion of the sub-combat unit on another side of the damper body compared with a point on the damper body where the body and the brake band first meet.

7 Claims, 1 Drawing Sheet

FLIP-OUT MECHANISM FOR TARGET TRACKERS

TECHNICAL FIELD

The present invention relates to a flip-out mechanism for target trackers for such sub-combat units, provided with their own target trackers and triggering sensors, as a carrier body or vehicle in the form of a shell or missile transported to a predetermined target area in order there to be discharged from the vehicle and, while the sub-combat unit falls in a spiral trajectory towards the earth, scans the target area with its sensors and combats any possible targets identified there, such as MBTs.

The basic principle of the sub-combat unit of the type contemplated here is described in SE-A2-8601423 (452405).

BACKGROUND OF THE INVENTION

The characterizing feature of the sub-combat unit described in the above patent is that it is provided not only with a flip-out target tracker and triggering sensor but also with a similarly flip-out designed carrier surface. In their flip-out positions, the target tracker and carrier surface together provide for the sub-combat unit a suitably balanced retarding area which imparts to the unit its predetermined fall velocity combined with the previously mentioned spiral fall trajectory, which makes it possible for the sensor to scan the pertinent target area for targets to be combatted.

SE-A0-8903473-0 and SE-A0-9001227-9 describe further variations of flip-out carrier surfaces intended for sub-combat units of the type contemplated here. Such carrier surfaces may also consist of parachutes.

As will be apparent from the above disclosure and in greater detail from the above-mentioned references, the sub-combat units are provided with a plurality of flip-out parts which, during ejection from the vehicle, must be protected from damage, while at the same time, the preplanned scanning of the target area requires that the flip-out of these parts takes place exactly as planned.

The flip-out of the target tracker implies no specific problems in such sub-combat units that have, at the desired flip-out time, at least a certain inherent rotation. In such an event, the flip-out operation can be left to the rotation forces and, thus, it is sufficient to simply release the target tracker in order to activate the flip-out operation. For example, this may be combined with the sub-combat unit being forced, by a powder charge adapted to this purpose, out of a protective canister in which it was initially discharged from that vehicle which had transported it to the pertinent target area. The rotation which is required in order thereafter to flip out the target tracker need not be particularly powerful. In one specific embodiment, we expect that the target tracker can be reliably flipped out at a rotation of the order of magnitude of 10 revolutions/second.

On the other hand, a problem may be experienced in realizing efficient and space-saving means for retarding the flipped-out target tracker in its flipped-out state and in locking the tracker in this position. Sub-combat units are of extremely limited size within which a complex electronics system must be accommodated, as well as one or more bulky warheads. The space which is available for means for retarding the target tracker in its flipped-out position and locking it there against further movement is, as a result, limited to the extreme. Moreover, the target tracker (which contains the major portion of the relevant electronics) must be retarded gently so that neither the electronics nor the anchorage of the target tracker is damaged, while at the same time the target tracker must be locked without any play in its flipped-out position. The object of the present invention is, therefore, to solve the above-outlined problems.

SUMMARY OF THE INVENTION

This is achieved according to the present invention such that the retardation is effected by means of an initially compressed flexible brake band which, for example, may be of thin steel and which, during flip-out of the target tracker from its one anchorage point in the proximity of that point on the target tracker which, on flip-out, moves the greatest distance, is stretched past an elastically deformable damper body secured in the main portion of the sub-combat unit and optionally consisting, for example, of rubber or other polymer material with suitable properties. In such instance, the damper body is disposed in relation to the stretching of the brake band such that it will, at least in the final phase of the flipping-out of the target tracker, be deformed which gives a resilient retardation of the flip-out movement of the target tracker. An extension of the brake band which has proved to be suitable is to secure it to one side of the damper body and cause it to extend in an arc around at least a part of the damper body before it extends further towards the first anchorage point in the target tracker.

A design which has proved to be advantageous comprises, on the one hand, the above-described retarding arrangement and, on the other hand, a return stop which is activated in such a manner that, in the final position, a certain pretensioning in the brake band will be obtained.

This is realized by adapting the different parts such that the target tracker is first flipped out to a maximum position which is slightly further out than the desired end position and, at the same time, a return stop which may consist of a simple leaf spring is allowed to yield, whereafter a portion of the elastic deformation of the damper device is caused to retract the target tracker until the return stop is activated. By retaining, in this final position, a part of the deformation of the damper body, a pretensioning of the brake band will be obtained and an efficient locking of the target tracker in the flipped-out position.

BRIEF DESCRIPTION OF THE ACCOMPANYING DRAWINGS

The method and the apparatus according to the present invention are defined in the appended claims and will now be described in greater detail hereinbelow with particular reference to the accompanying Drawings.

DESCRIPTION OF PREFERRED EMBODIMENT

Figure 1:
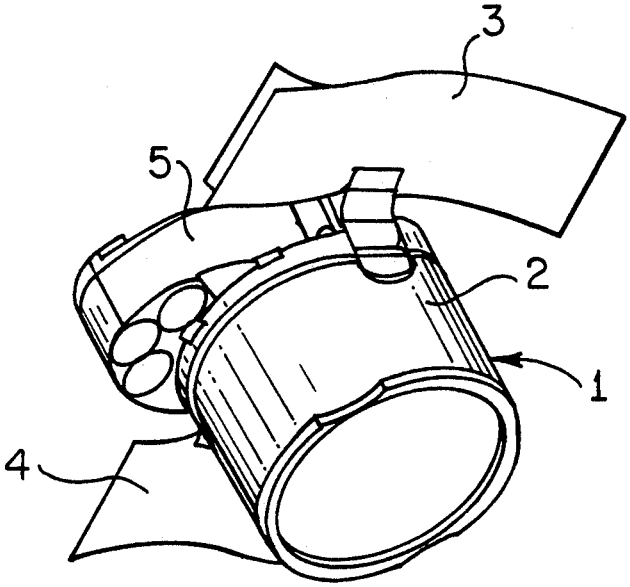
FIG. 1 shows a sub-combat unit of the type contemplated here under retarded fall.

FIG. 1 shows a sub-combat unit 1 during a retarded fall. Its main portion consists of a warhead charge 2, but it is also provided with two flip-out carrier surfaces 3 and 4 and the flip-out target tracker 5 relevant in the context of the present invention.

In FIG. 1 all flip-out devices are in the flip-out position.

Figure 2:
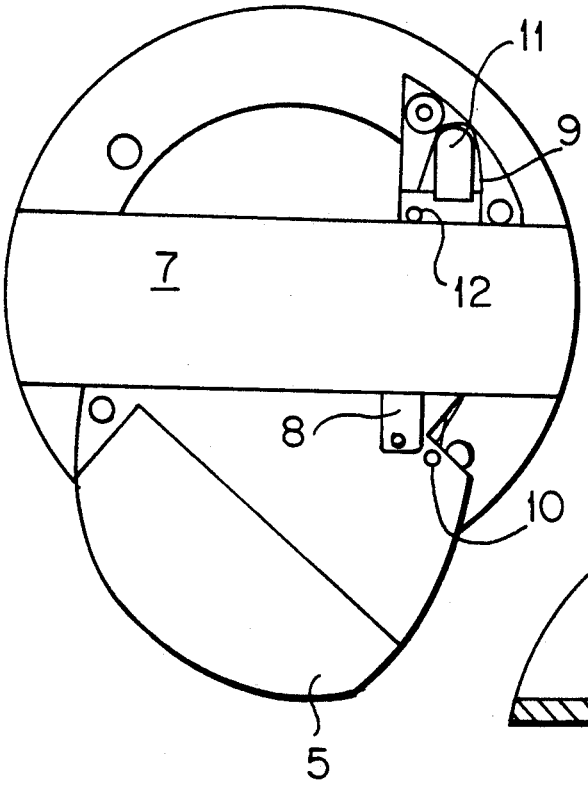
FIG. 2 shows the upper portion of the same sub-combat unit seen from above (the flip-out carrier surfaces which are not germane to the present invention have not, however, been included)

It is apparent from FIG. 2, which thus shows the sub-combat unit seen from above, the flip-out target tracker 5 (which is flipped out in the figure) is pivotally journalled about a pin 6, and the sub-combat unit has a superjacent carrier beam 7 against which a return stop 8 disposed on the target tracker has been raised to start position in order thereby to prevent the target tracker 5 from returning to the starting position. The return stop 8 consists, in this specific case, of a simple leaf spring which yields and constitutes an efficient stop as soon as it has passed out beneath the carrier beam 7.

Figure 3:
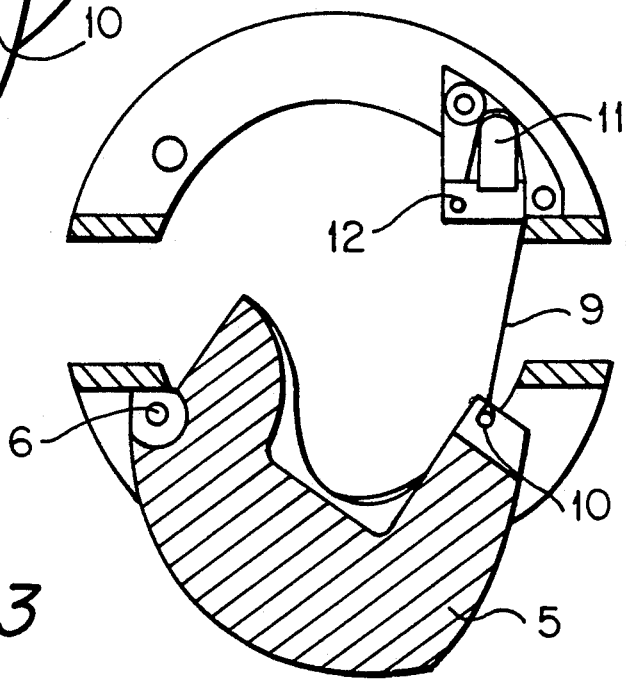
FIG. 3 is a section through the upper portion of the sub-combat unit according to the present invention as illustrated in FIG. 2.

The retarding device, of the present invention which is most readily apparent from FIG. 3, consists of the brake band 9 which is secured in the target tracker 5 at a first anchorage point 10. Thence, the brake band 9 runs in an arc about a damper device 11 to the second anchorage point 12 on the other side of the damper device. This in turn consists of an elastically deformable rubber stud.

In the initial phase, the target tracker 5 is retracted and the brake band 9 folded in inside the target tracker. The return stop 8 in turn is clamped in beneath the carrier beam 7.

When the target tracker is flipped out by the rotational force or by other means, the brake band 9 will first be stretched and thereafter at least partly deform the damper device 11. In such instance, a gentle retardation of the flipping-out of the target tracker will be obtained. Given the correctly adapted properties of the damper device 11, the target tracker will be flipped out a slight distance further than to its intended final position. In this instance, the return stop is given the opportunity to yield, whereafter the elasticity of the damper device comes into play and attempts to reassume its original form, the brake band being retracted by the target tracker so that the return stop 8 abuts against the carrier beam 7 and is retained in this position by a certain residual deformation of the damper device, this providing a pretensioning which prevents any further movement on the part of the target tracker.

The present invention should not be considered as restricted to that described above and shown on the drawings, many modifications being conceivable without departing from the spirit and scope of the appended claims.

What we claim and desired to secure by Letters Patent is:

1. A method of retarding the movement of the flip-out target tracker during a final part of a flip-out without the contents or journalling of the target tracker being damaged, said flip-out target tracker being on a sub-combat unit of a type which is transported by a carrier body to a predetermined target area in order to be activated at the target area during flip-out of the target tracker, said target tracker scanning the target area during the braked fall of the sub-combat unit and identifying and combating targets by means of an integrated warhead, said method comprising:

providing a flexible brake band for effecting the retardation, said brake band being an initially folded, flexible brake band attached to said target tracker at a first anchorage point in the proximity of a portion of said target tracker which, during flip-out, moves the longest distance;

stretching said brake band past an elastically deformable damper body secured in a main portion of the sub-combat unit; and causing said damper body to be at least partially deformed by the brake band during the final stage of the flip-out phase so that the brake band is stretched between said first anchorage point and a second anchorage point in the main portion of the sub-combat unit on another side of the damper body compared with a point on the damper body where the body and the brake band first meet.

2. The method according to claim 1, wherein the elastically deformable properties of the damper body initially permit the target tracker to be flipped out to a maximum position at least partially further out than its intended final postion and then to be influenced such that it is retracted to a stop position against a stop member, said stop member being activated during the flip-out of the target tracker to a maximum position.

3. A retarder device for use in braking in a predetermined flip-out position, a flip-out target tracker of the type which is included in sub-combat units transported by a carrier body to a predetermined target area over which the sub-combat unit is dropped in order to scan the target area with its target tracker during braked fall towards the target area and combat any possible identified targets in the area by means of an integral warhead, said retarder device comprising:

a flexible brake band which has a first anchorage point in the target tracker in the proximity of a point thereon which, on flip-out, travels the furthest distance and a second anchorage point in the main part of the sub-combat unit;

an elastically deformable damper body secured in a main potion of the sub-combat unit, the damper body being at least slightly deformed when the target tracker is flipped out, the brake band extending, when the target tracker is wholly flipped out in a tensioned position, from the first to the second anchorage points, past said damper body.

4. The retarder device according to claim 3, wherein said brake band runs in an arc from said second anchorage point which lies on a first side of the damper body, about an end wall side of the damper body and along a second opposite side of the damper body to the first anchorage point.

5. The retarder device according to claim 3, wherein the brake band is made of steel and the damper body is made of rubber or another polymer having suitable elastic deformable properties.

6. The retarder device according to claim 3, further comprising a resilient return stop member which is operative when the target tracker has been flipped out to a maximum position, said return stop member yielding when the damper body resiliently returns, to arrest the return movement of the target tracker; said damper body being adapted such that a certain pretensioning of the damper body and the brake band remains upon the arresting of the return movement of the target tracker.

7. The retarder device according to claim 6, wherein the return stop member comprises a yieldable leaf spring.

* * * * *